US009724257B1

(12) United States Patent
Chen et al.

(10) Patent No.: US 9,724,257 B1
(45) Date of Patent: Aug. 8, 2017

(54) ANTI-BEDSORE BED

(71) Applicants: Li-Ling Chen, Taichung (TW); Tsair-Rong Chen, Changhua (TW); Yi-Lung Lee, Changhua (TW); Yu-Lin Juan, Changhua (TW); Chih-Chung Wang, Changhua (TW)

(72) Inventors: Li-Ling Chen, Taichung (TW); Tsair-Rong Chen, Changhua (TW); Yi-Lung Lee, Changhua (TW); Yu-Lin Juan, Changhua (TW); Chih-Chung Wang, Changhua (TW)

(73) Assignees: TERA AUTOTECH CORPORATION, Taichung (TW); Dept. of Electrical Engineering, National Changhua University of Education

( * ) Notice: Subject to any disclaimer, the term of this patent is extended or adjusted under 35 U.S.C. 154(b) by 0 days.

(21) Appl. No.: 15/586,193

(22) Filed: May 3, 2017

(51) Int. Cl.

| | |
|---|---|
| ***A61G 7/015*** | (2006.01) |
| ***A61G 7/018*** | (2006.01) |
| ***A61G 7/057*** | (2006.01) |
| ***A61G 5/00*** | (2006.01) |

(52) U.S. Cl.
CPC ..... *A61G 7/0573* (2013.01); *A61G 5/006* (2013.01); *A61G 7/015* (2013.01); *A61G 7/018* (2013.01); *A61G 7/05769* (2013.01)

(58) Field of Classification Search
CPC ..... A61G 7/002; A61G 7/015; A61G 7/018; A61G 13/02; A61G 13/08; A47C 21/006; A47C 27/04; A47C 27/06; A47C 31/00; A61H 1/008; A61H 1/0292; A61H 2201/0138; A61H 2201/0142; A61H 2201/0149; A61H 2205/81; A61H 15/00; A61H 15/0078
USPC ..... 5/616, 613, 716, 722, 933, 944; 601/97, 601/98, 101, 103; 606/237–239
See application file for complete search history.

(56) References Cited

U.S. PATENT DOCUMENTS

| | | | | | |
|---|---|---|---|---|---|
| 66,849 | A * | 7/1867 | Johnson | A47C 23/002 | 5/248 |
| 97,579 | A * | 12/1869 | Wittram | A47C 9/00 | 297/461 |
| 1,303,475 | A * | 5/1919 | Hardy | A61H 23/0254 | 601/93 |
| 1,375,652 | A * | 4/1921 | Carlotti | 601/97 | |
| 1,617,593 | A * | 2/1927 | Hardy | 601/97 | |

(Continued)

*Primary Examiner* — Robert G Santos
(74) *Attorney, Agent, or Firm* — Che-Yang Chen; Law Offices of Scott Warmuth

(57) ABSTRACT

An anti-bedsore bed may comprise a bed unit, a first bed body, and a second bed body. The bed unit has a first mattress, and a bottom portion is coupled on a bottom surface thereof. Moreover, the bottom portion comprises six supporting units evenly arranged into three sets at positions corresponding to a user's upper, middle and lower back, and each of the supporting units has a sliding block moveably mounted on an upper surface of the bottom portion. Furthermore, each of the sliding blocks has a supporting rod, and an abutting unit is pivotally connected to an upper end of the supporting rod. The supporting rods are configured to move upwardly in a preset time interval, and the abutting units are adapted to uplift a user's body to detach from the first mattress for a designed time, thereby achieving the anti-bedsore effect.

10 Claims, 9 Drawing Sheets

(56) References Cited

U.S. PATENT DOCUMENTS 1,999,412 A * 4/1935 Hardy ..... 606/239
2,360,975 A * 10/1944 Petersen ..... 601/97
2,445,158 A * 7/1948 Sparhawk ..... A61G 7/0573 5/611
2,773,498 A * 12/1956 Himmelman ..... 5/934
3,081,129 A * 3/1963 Ridder ..... A47C 23/002 297/284.3
3,298,363 A * 1/1967 Parkin ..... 5/236.1
3,551,924 A * 1/1971 Frye, Sr. ..... A47C 23/0435 5/248
3,656,190 A * 4/1972 Regan ..... A47C 23/00 5/600
3,999,234 A * 12/1976 Regan ..... A47C 23/002 5/246
4,134,168 A * 1/1979 Guigan ..... A61G 7/057 5/600
5,235,710 A * 8/1993 Nagashima ..... A47C 23/065 4/547
5,237,501 A * 8/1993 Gusakov ..... A61G 7/0573 600/587
5,446,933 A * 9/1995 Gabelhouse ..... A47C 23/002 5/670
6,721,981 B1 * 4/2004 Greenhalgh ..... A47C 23/002 5/253
7,520,011 B1 * 4/2009 Liberkowski ..... A47C 23/002 5/719
9,119,478 B2 * 9/2015 DeFranks ..... A47C 27/06
9,226,591 B2 * 1/2016 DeFranks ..... A47C 27/06
9,259,097 B2 * 2/2016 Saunders ..... A47C 27/06
9,314,108 B2 * 4/2016 DeFranks ..... A47C 27/04
9,314,109 B2 * 4/2016 Saunders ..... A47C 27/04
2014/0137333 A1 * 5/2014 DeFranks ..... A47C 27/06 5/716
2014/0137334 A1 * 5/2014 DeFranks ..... A47C 27/06 5/716
2014/0137335 A1 * 5/2014 DeFranks ..... A47C 27/06 5/716
2014/0137336 A1 * 5/2014 DeFranks ..... A47C 27/06 5/717
2014/0137337 A1 * 5/2014 DeFranks ..... A47C 27/06 5/723

* cited by examiner

ANTI-BEDSORE BED

FIELD OF THE INVENTION

The present invention relates to a medical bed and more particularly to an anti-bedsore bed.

BACKGROUND OF THE INVENTION

Bedsores also called pressure sores or pressure ulcers are injuries to skin and underlying tissue resulting from prolonged pressure on the skin. Bedsores generally happen to a patient who has limitations on moving their body such as paralysis patient, and the skin and underlying tissue are pressured and have ulcers due to poor blood circulation. Thus, turning and re-positioning the patient in the bed to keep the skin free from exposure to urine and stool become very important. For taking care of this kind of patient, a nurse or caregiver needs to turn or re-position the patient in every 1 to 2 hours.

However, frequently re-positioning the patient puts a huge strain to the nurse or caregiver, and when the bed needs to be cleaned or disinfected, it may need more labors. Therefore, there remains a need for a new and improved design for an anti-bedsore bed to overcome the problems presented above.

SUMMARY OF THE INVENTION

The present invention provides an anti-bedsore bed which comprises a bed unit, a first bed body, and a second bed body. The bed unit has a first mattress, and a bottom portion is coupled on a bottom surface thereof. Moreover, the bottom portion comprises six supporting units evenly arranged into three sets at positions corresponding to a user's upper back, middle portion of back and lower back, and each of the supporting units has a sliding block moveably mounted on an upper surface of the bottom portion. Furthermore, each of the sliding blocks has a supporting rod, and an abutting unit is pivotally connected to an upper end of the supporting rod. Each of first power units secured on a bottom surface of the sliding block is engaged with the supporting rod while each of second power units secured on the bottom portion is engaged with the sliding block such that the supporting rod can be driven by the first power unit to move upwardly or downwardly, and the second power unit can drive the sliding block to move in lateral directions. Moreover, the positions of the supporting units are adjustable according to a position of the back portion of a user. The first mattress has a plurality of through holes located at positions corresponding to the supporting units such that the abutting units are respectively accommodated in the through holes before the supporting rods moved upwardly or are respectively protrude out of the through holes when the supporting rods are lifted. The first bed body and the second bed body are coupled side by side for use, and the first bed body has a bed stead which is configured to support the bottom portion of the bed unit. The second bed body comprises a first frame, a second frame and a third frame, which are pivotally connected in sequence. A second bed mattress is positioned on an upper surface of the first frame, the second frame and the third frame, and at least two sliding wheels are installed at a lower portion of the second frame to enable the second bed body to be movable. Moreover, each of the first frame and the third frame has at least two bed legs pivotally assembled at a lower portion thereof, and the bed legs are configured to perform between an unfolded position standing on the floor and a folded position received in the first frame or the third frame. Additionally, the third frame and the first frame are configured to be respectively folded up and down relative to the second frame, and after securing pivots between the first frame and the second frame and between the second frame and the third frame, the second bed body can be used as a wheelchair.

Comparing with conventional medical bed, the present invention is advantageous because: (i) the supporting rods are configured to move upwardly in a preset time interval, and the abutting units are adapted to uplift a user's body to detach from the first mattress for a designed time, thereby achieving the anti-bedsore effect; (ii) with the anti-bedsore bed cooperating with a control unit, a nurse or a caregiver can save more time and energy to turn the patient; and (iii) the second bed body not only can be used for the caregiver, but also for a patient when the bed unit and the first bed body need to be cleaned and disinfected or as a wheelchair when the patient needs to go out, which saves labors and time.

DETAILED DESCRIPTION OF THE INVENTION

The detailed description set forth below is intended as a description of the presently exemplary device provided in accordance with aspects of the present invention and is not intended to represent the only forms in which the present invention may be prepared or utilized. It is to be understood, rather, that the same or equivalent functions and components may be accomplished by different embodiments that are also intended to be encompassed within the spirit and scope of the invention.

Unless defined otherwise, all technical and scientific terms used herein have the same meaning as commonly understood to one of ordinary skill in the art to which this invention belongs. Although any methods, devices and materials similar or equivalent to those described can be used in the practice or testing of the invention, the exemplary methods, devices and materials are now described.

All publications mentioned are incorporated by reference for the purpose of describing and disclosing, for example, the designs and methodologies that are described in the publications that might be used in connection with the presently described invention. The publications listed or discussed above, below and throughout the text are provided solely for their disclosure prior to the filing date of the present application. Nothing herein is to be construed as an admission that the inventors are not entitled to antedate such disclosure by virtue of prior invention.

Figure 7:
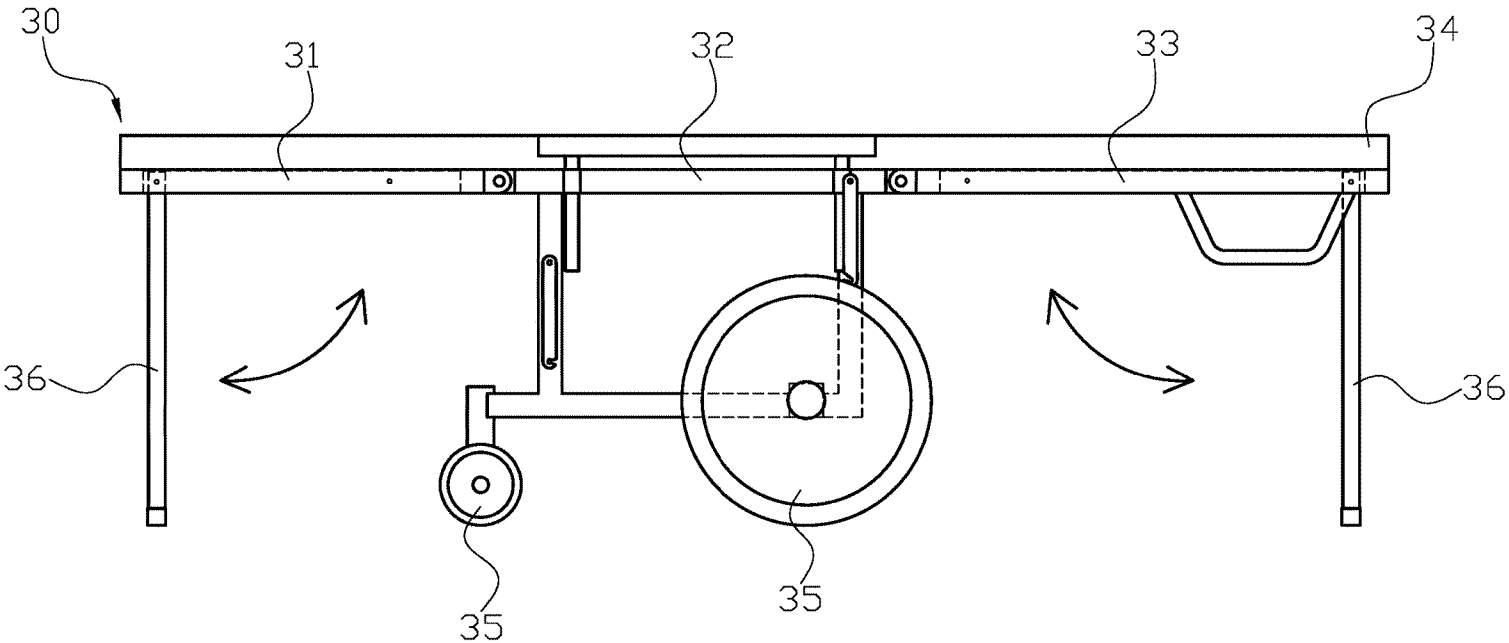
FIG. 7 is a schematic view illustrating two bed legs are respectively received in a first frame and a third frame of the second bed body of the anti-bedsore bed in the present invention.
Figure 8:
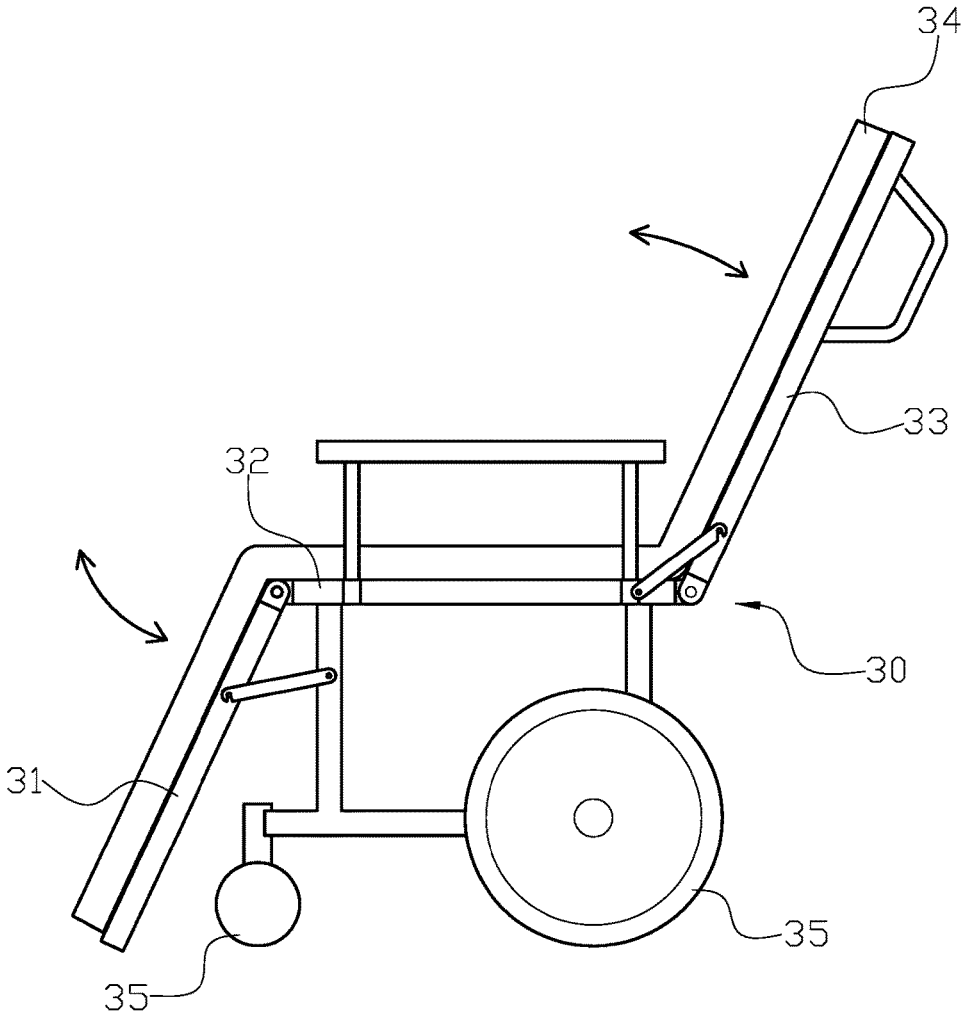
FIG. 8 is a plan view illustrating the second bed body is folded and used as a wheelchair.
Figure 9:
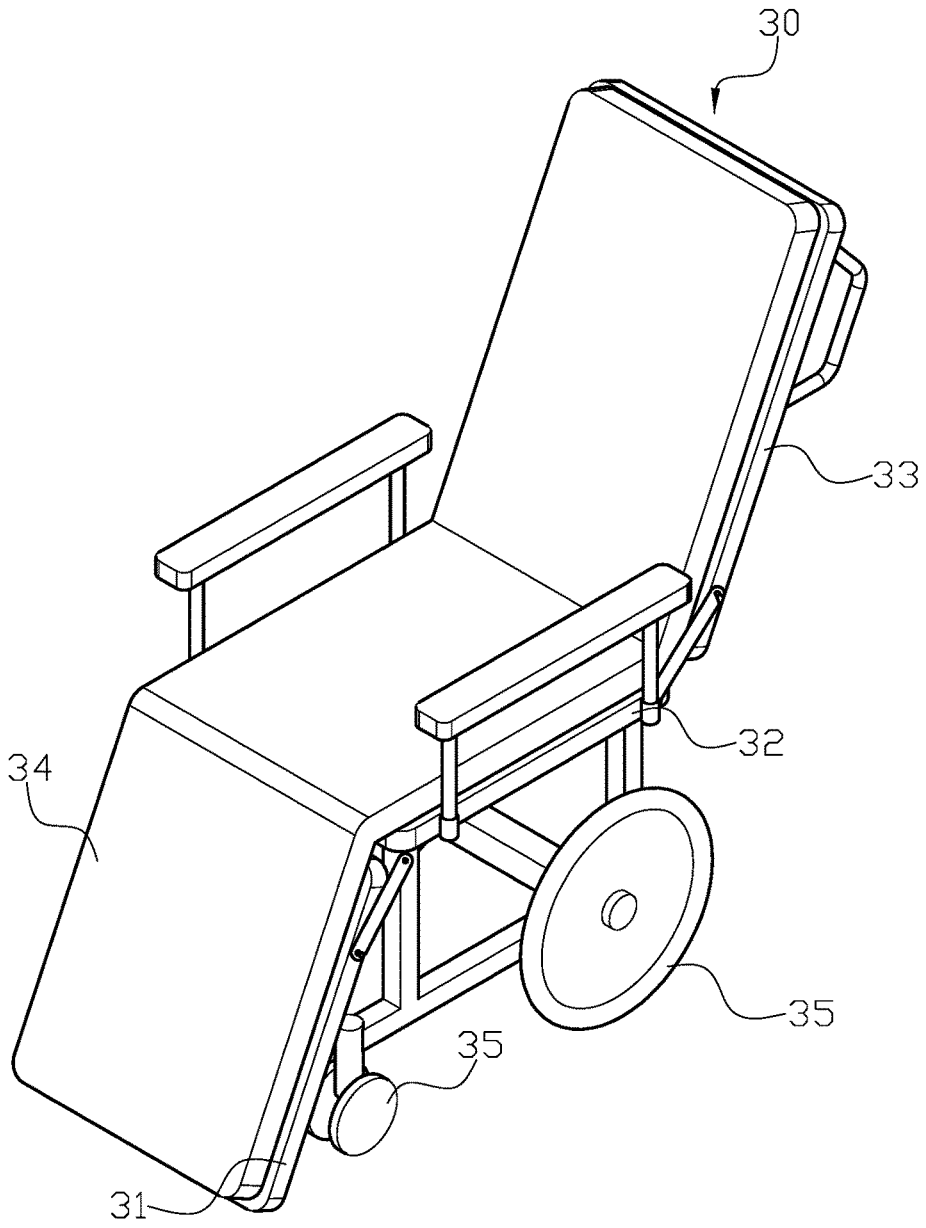
FIG. 9 is a three-dimensional assembly view illustrating the second bed body is folded and used as a wheelchair.

In order to further understand the goal, characteristics and effect of the present invention, a number of embodiments along with the drawings are illustrated as following:

Referring to FIGS. 1 to 5, the present invention provides an anti-bedsore bed which comprises a bed unit (10), a first bed body (20), and a second bed body (30). The bed unit (10) has a first mattress (11), and a bottom portion (12) is coupled on a bottom surface thereof. Moreover, the bottom portion (12) comprises six supporting units (13) evenly arranged into three sets at positions corresponding to a user's upper back, middle portion of back and lower back, and each of the supporting units (13) has a sliding block (131) moveably mounted on an upper surface of the bottom portion (12). Furthermore, each of the sliding blocks (131) has a supporting rod (132), and an abutting unit (133) is pivotally connected to an upper end of the supporting rod (132). Each of first power units (134) secured on a bottom surface of the sliding block (131) is engaged with the supporting rod (132) while each of second power units (135) secured on the bottom portion (12) is engaged with the sliding block (131) such that the supporting rod (132) can be driven by the first power unit (134) to move upwardly or downwardly, and the second power unit (135) can drive the sliding block (131) to move in lateral directions. Moreover, the positions of the supporting units (13) are adjustable according to a position of the back portion of a user. The first mattress (11) has a plurality of through holes (111) located at positions corresponding to the supporting units (13) such that the abutting units (133) are respectively accommodated in the through holes (111) before the supporting rods (132) are moved upwardly or respectively protrude out of the through holes (111) when the supporting rods (132) are lifted. The first bed body (20) and the second bed body (30) are coupled side by side for use, and the first bed body (20) has a bed stead (21) which is configured to support the bottom portion (12) of the bed unit (10). The second bed body (30) comprises a first frame (31), a second frame (32) and a third frame (33), which are pivotally connected in sequence. A second bed mattress (34) is positioned on an upper surface of the first frame (31), the second frame (32) and the third frame (33), and at least two sliding wheels (35) are installed at a lower portion of the second frame (32) to enable the second bed body (30) to be movable. Moreover, each of the first frame (31) and the third frame (33) has at least two bed legs (36) pivotally assembled at a lower portion thereof, and the bed legs (36) are configured to perform between an unfolded position standing on the floor and a folded position received in the first frame (31) or the third frame (33) (as shown in FIG. 7). Additionally, the third frame (33) and the first frame (31) are configured to be respectively folded up and down relative to the second frame (32) (as shown in FIG. 8), and after securing pivots between the first frame (31) and the second frame (32) and between the second frame (32) and the third frame (33), the second bed body (30) can be used as a wheelchair (as shown in FIG. 9).

In one embodiment, the first bed body (20) is a medical bed of hospital, and a user can directly install the bed unit (10) on the bed stead (21) of the first bed body (20) to achieve the anti-bedsore effect.

In another embodiment, the bottom portion (12) of the bed unit (10) comprises at least four bed boards pivotally coupled in sequence.

In still another embodiment, at least two sliding grooves (121) are separately positioned at a lower portion of an interior space of the bottom portion (12), and each of the sliding blocks (131) has at least four wheels (1311) evenly formed at two lateral ends thereof and respectively received in and movable along the two sliding grooves (121), and each of the second power units (135) is secured on the supporting bar (122) between the two adjacent sliding grooves (121).

In a further embodiment, each of the first power units (134) is a first motor (1341) having a gear wheel (1342) rotatably mounted on a spindle thereof, and the gear wheel (1342) is configured to be engaged with the supporting rod (132) which is formed in a gear rack such that the first motor (1341) can drive the supporting rod (132) to move upwardly or downwardly; and the first motor (1341) has a function of vibration to massage a user through the abutting unit (133) when the supporting rod (132) is moved.

In still a further embodiment, each of the second power units (135) comprises a second motor (1351) and a screw rod (1352) cooperated with each other, and a screw nut (1312) secured on the bottom surface of the sliding block (131) is moveably engaged with the screw rod (1352) such that the second motor (1351) can drive the sliding block (131) to have movement in lateral directions.

In yet a further embodiment, the abutting unit (133) is a cushion having a top surface which is slightly concaved at a central portion thereof.

In a particular embodiment, the abutting unit (133) is an air bag which can be inflated and deflated.

In a preferred embodiment, the abutting unit (133) is connected to an air pump through a hose (136) such that a hot air or a cold air can be provided through the hose (136) to the abutting unit (133), enabling the bed unit (10) to be used in different weathers.

In an advantageous embodiment, the supporting units (13) are electrically connected to a control unit which is provided to control the supporting units (13) to perform different actuation patterns and to control the time intervals of the actuations of the supporting units (13).

Figure 1:
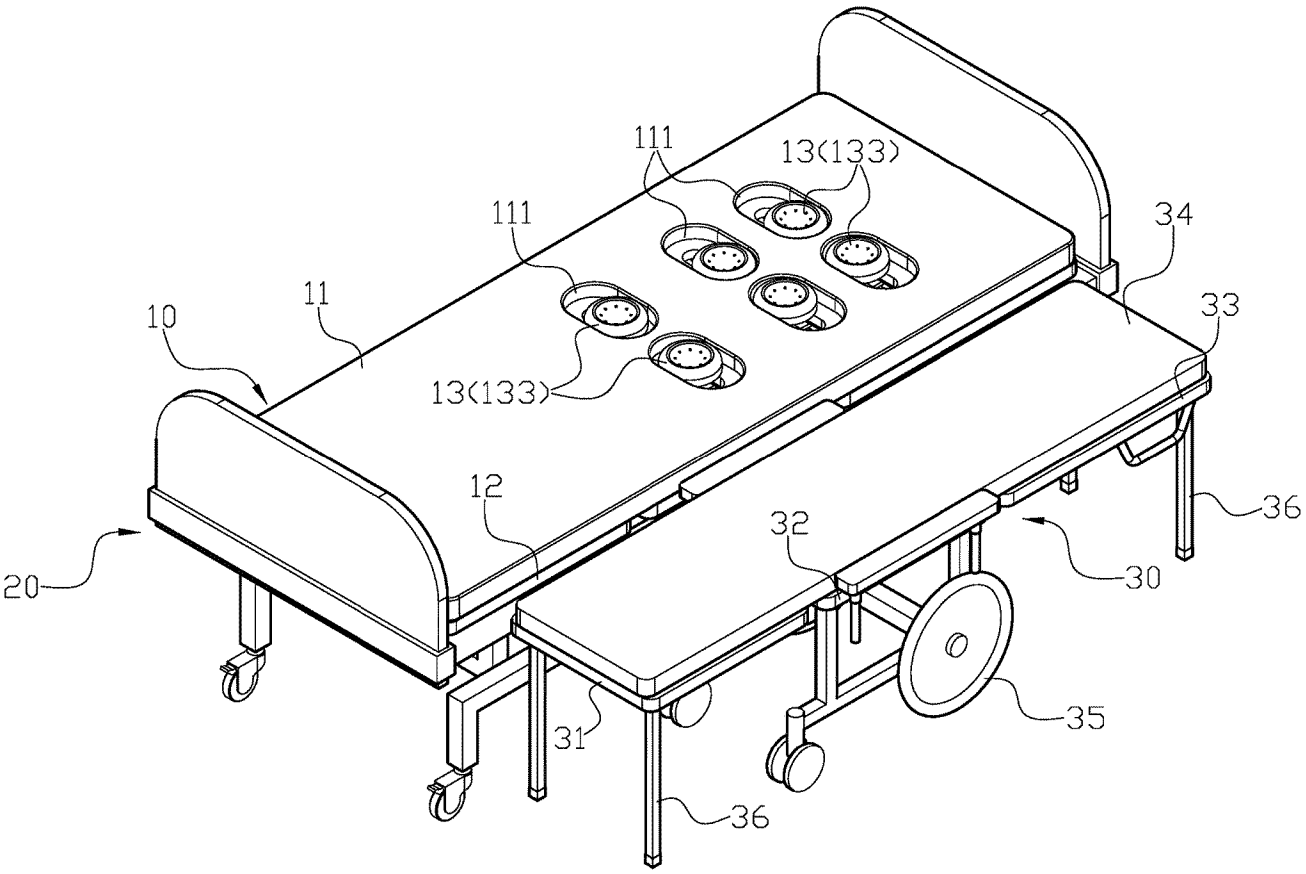
FIG. 1 is a three-dimensional assembly view illustrating a first bed body and a second bed body of an anti-bedsore bed of the present invention are coupled side by side for use.
Figure 2:
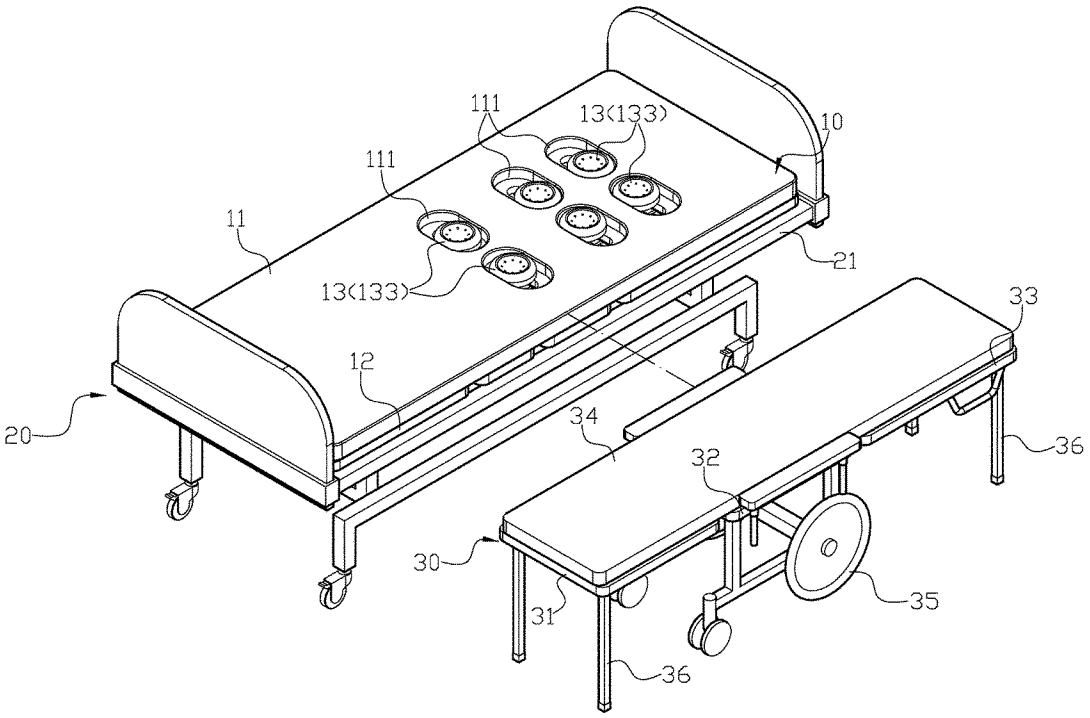
FIG. 2 is a three-dimensional exploded view of the anti-bedsore bed of the present invention.
Figure 3:
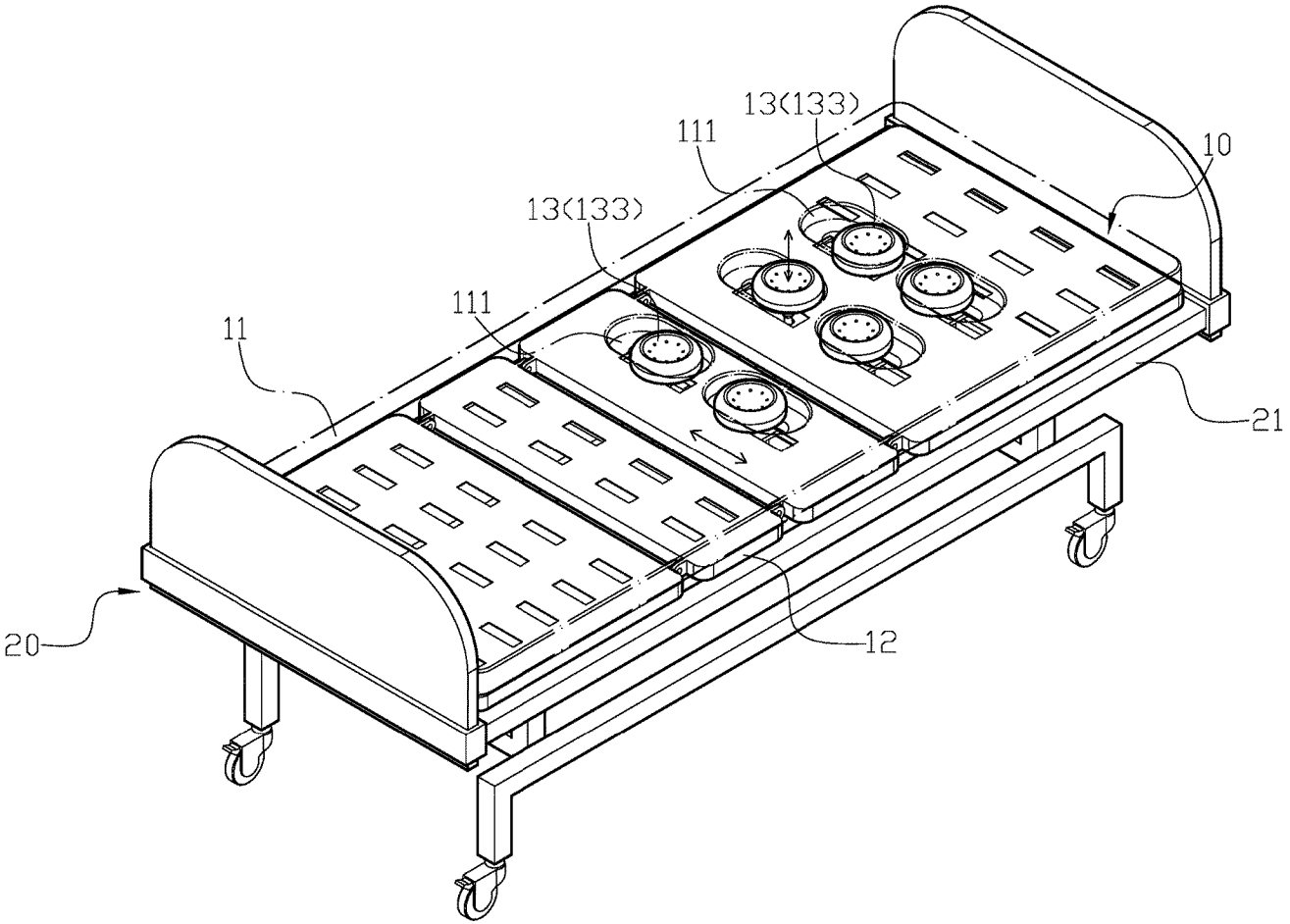
FIG. 3 is a three-dimensional assembly view illustrating a bed unit of the anti-bedsore bed is assembled with the first bed body in the present invention.
Figure 4:
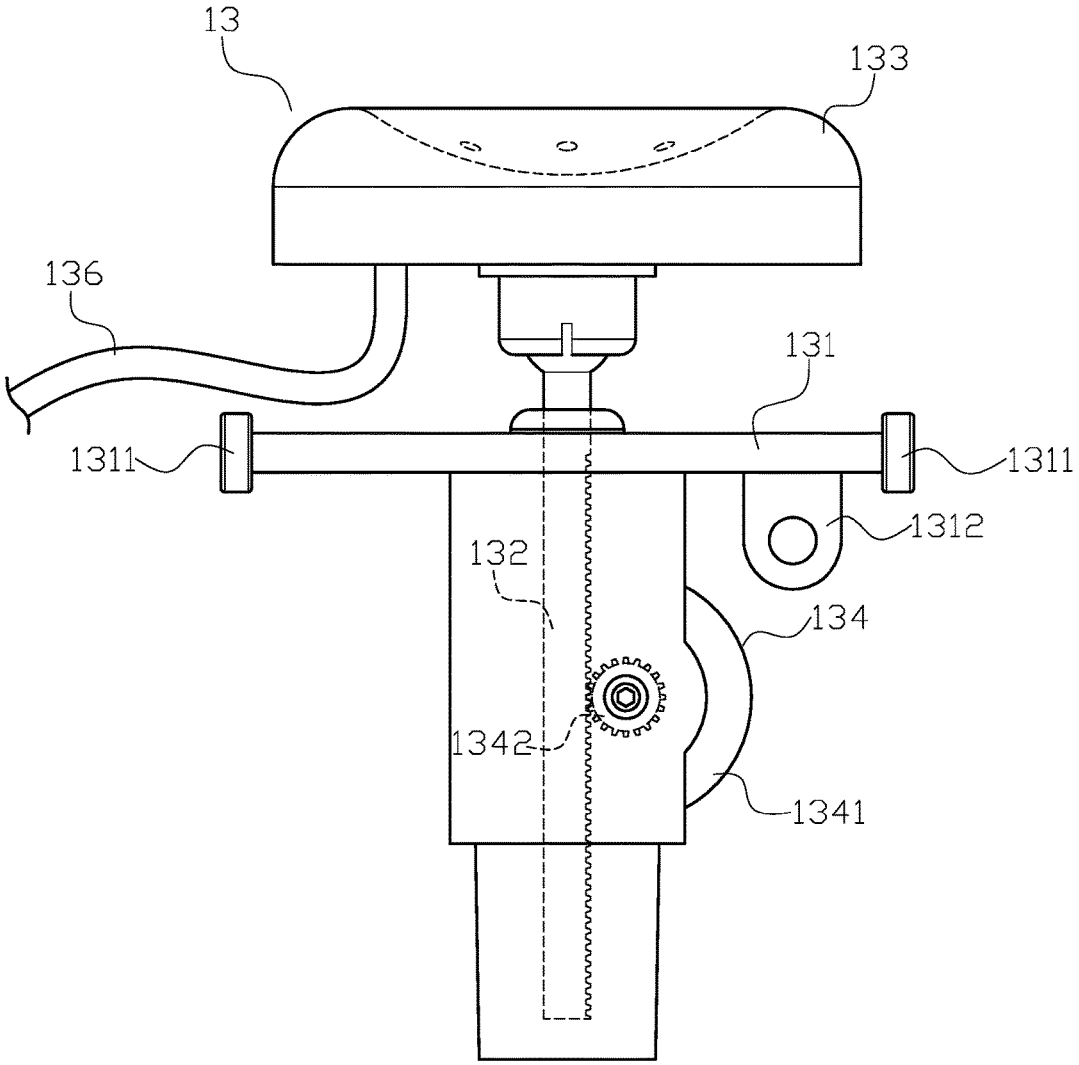
FIG. 4 is a plan view of a supporting unit of the anti-bedsore bed of the present invention.
Figure 5:
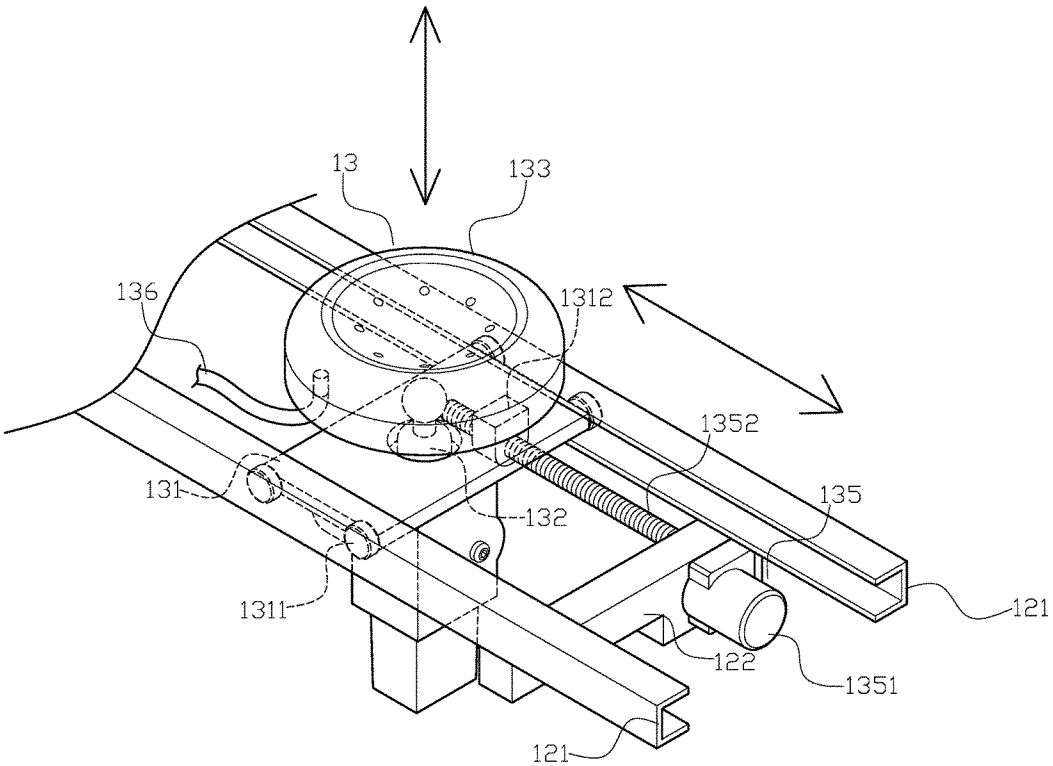
FIG. 5 is a three-dimensional assembly view of the anti-bedsore bed of the present invention.
Figure 6:
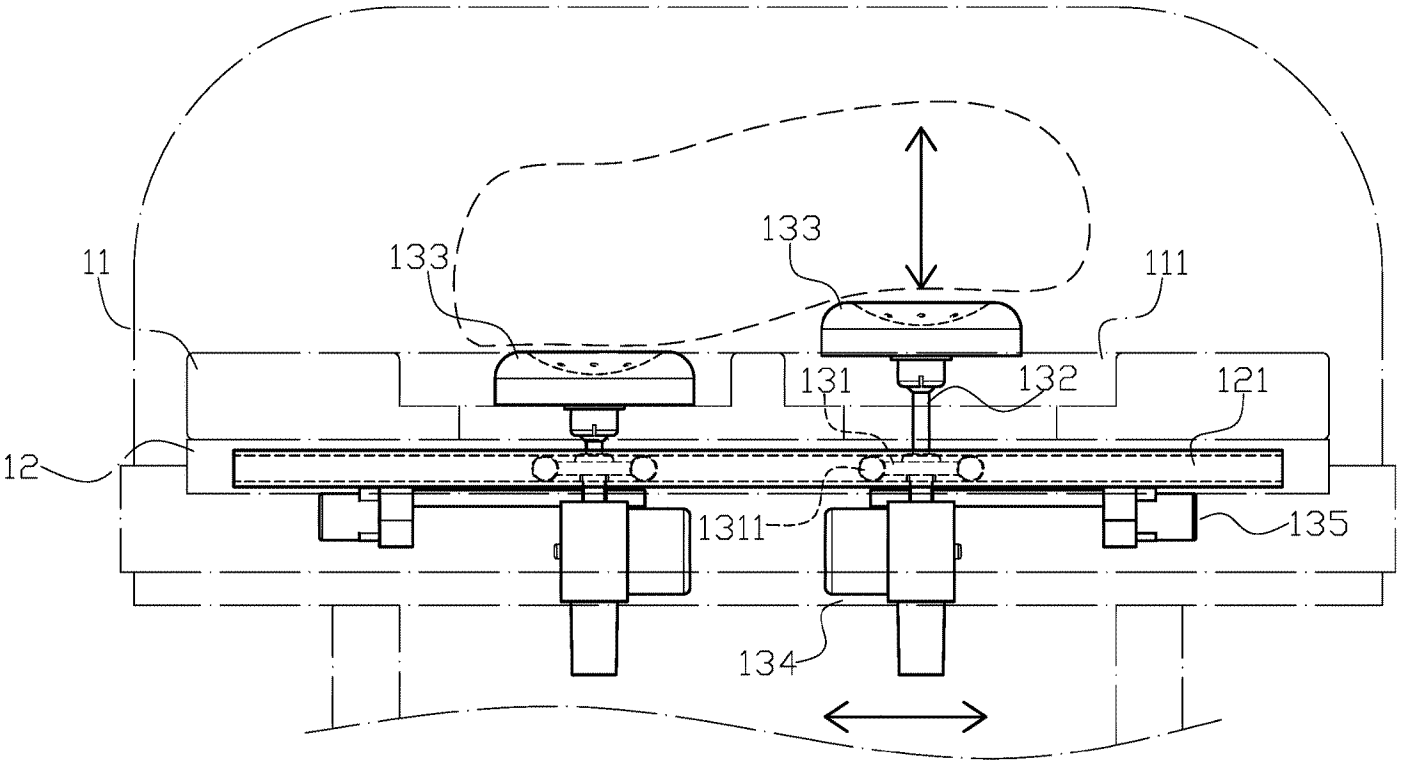
FIG. 6 is a schematic view illustrating a supporting rod of the supporting unit of the anti-bedsore bed is lifted in the present invention.

In actual application, the supporting rods (132) are configured to move upwardly in a preset time interval, and the abutting units (133) are adapted to uplift a user's body to detach from the first mattress (11) for a designed time (as shown in FIG. 6), thereby achieving the anti-bedsore effect. As a result, with the anti-bedsore bed of the present invention, a nurse or a caregiver can save more time and energy to turn the patient. Furthermore, the second bed body (30) not only can be used for the caregiver, but also for a patient when the bed unit (10) and the first bed body (20) need to be cleaned and disinfected or as a wheelchair when the patient needs to go out, which saves labors and time.

Having described the invention by the description and illustrations above, it should be understood that these are exemplary of the invention and are not to be considered as limiting. Accordingly, the invention is not to be considered as limited by the foregoing description, but includes any equivalents.

What is claimed is:

1. An anti-bedsore bed comprising:

a bed unit having a first mattress, and a bottom portion, which is coupled on a bottom surface of the first mattress, comprising six supporting units evenly arranged into three sets at positions configured to correspond to a user's upper, middle, and lower back, and each of the supporting units having a sliding block moveably mounted on an upper surface of the bottom portion; each of the sliding blocks having a supporting rod, and an abutting unit pivotally connected to an upper end of the supporting rod; each of first power units, which is secured on a bottom surface of the sliding block, engaged with the supporting rod while each of second power units, which is secured on the bottom portion, engaged with the sliding block such that the supporting rod configured to be driven by the first power unit to move upwardly or downwardly and the second power unit adapted to drive the sliding block to move in lateral directions; the positions of the supporting units configured to be adjustable according to a position of the back portion of a user; the first mattress having a plurality of through holes located at positions corresponding to the supporting units such that the abutting units respectively accommodated in the through holes before the supporting rods are moved upwardly or the abutting units respectively protruding out of the through holes when the supporting rods are lifted;

a first bed body coupled with a second bed body side by side for use, and the first bed body having a bed stead configured to support the bottom portion of the bed unit; and the second bed body comprising a first frame, a second frame and a third frame, which are pivotally connected in sequence, and a second bed mattress positioned on an upper surface of the first frame, the second frame and the third frame, and at least two sliding wheels installed at a lower portion of the second frame to enable the second bed body to be movable; each of the first frame and the third frame having at least two bed legs pivotally assembled at a lower portion thereof, and the bed legs are configured to move between an unfolded position standing on the floor and a folded position received in the first frame or the third frame; the third frame and the first frame adapted to be respectively folded up and down relative to the second frame, and after securing pivots between the first frame and the second frame and between the second frame and the third frame, the second bed body is configured to be used as a wheelchair.

2. The anti-bedsore bed of claim 1, wherein the first bed body is a medical bed, and the bed unit is configured to be directly installed on the bed stead of the first bed body to achieve an anti-bedsore effect.

3. The anti-bedsore bed of claim 1, wherein the bottom portion of the bed unit comprises at least four bed boards pivotally coupled in sequence.

4. The anti-bedsore bed of claim 1, wherein at least two sliding grooves are separately positioned at a lower portion of an interior space of the bottom portion, and each of the sliding blocks has at least four wheels evenly formed at two lateral ends thereof and respectively received in and movable along the two sliding grooves, and each of the second power units is secured on a supporting bar between the two adjacent sliding grooves.

5. The anti-bedsore bed of claim 1, wherein each of the first power units is a first motor having a gear wheel rotatably mounted on a spindle thereof, and the gear wheel is configured to be engaged with the supporting rod which is formed in a gear rack such that the first motor is configured to drive the supporting rod to move upwardly or downwardly; and the first motor has a function of vibration to massage a user through the abutting unit when the supporting rod is moved.

6. The anti-bedsore bed of claim 1, wherein each of the second power units comprises a second motor and a screw rod cooperated with each other, and a screw nut secured on the bottom surface of the sliding block is moveably engaged with the screw rod such that the second motor is provided to drive the sliding block to have movement in lateral directions.

7. The anti-bedsore bed of claim 1, wherein the abutting unit is a cushion having a top surface which is slightly concaved at a central portion thereof.

8. The anti-bedsore bed of claim 1, wherein the abutting unit is an air bag which is configured to be inflated and deflated.

9. The anti-bedsore bed of claim 1, wherein the abutting unit is connected to an air pump through a hose.

10. The anti-bedsore bed of claim 1, wherein the supporting units are electrically connected to a control unit which is provided to control the supporting units to perform different actuation patterns and to control the time intervals of the actuations of the supporting units.

* * * * *